US007624575B2

(12) United States Patent
Noelle et al.

(10) Patent No.: US 7,624,575 B2
(45) Date of Patent: Dec. 1, 2009

(54) EGR MIXER AND PORTED SHROUD COMPRESSOR HOUSING

(75) Inventors: Phillipe Noelle, Vincey (FR); Robert Mavir, Bolton (GB)

(73) Assignee: Honeywell International Inc., Morristown, NJ (US)

( * ) Notice: Subject to any disclaimer, the term of this patent is extended or adjusted under 35 U.S.C. 154(b) by 354 days.

(21) Appl. No.: 11/608,624

(22) Filed: Dec. 8, 2006

(65) Prior Publication Data

US 2008/0134678 A1 Jun. 12, 2008

(51) Int. Cl.
*F02B 33/44* (2006.01)

(52) U.S. Cl. ..... 60/605.1; 60/605.2

(58) Field of Classification Search ..... 60/605.1, 60/605.2

See application file for complete search history.

(56) References Cited

U.S. PATENT DOCUMENTS 5,905,233 A * 5/1999 Gobert ..... 181/229
2002/0071765 A1 6/2002 Sahay et al.
2003/0085071 A1* 5/2003 Boast et al. ..... 181/249
2005/0188693 A1 9/2005 Schmid et al.
2006/0045764 A1 3/2006 Thompson et al.
2007/0271921 A1* 11/2007 Chen ..... 60/605.2

FOREIGN PATENT DOCUMENTS

| | | |
|---|---|---|
| DE | 4213047 A1 | 10/1993 |
| DE | 10116643 | 10/2002 |
| DE | 10321572 A1 | 12/2004 |
| EP | 1867865 | 12/2007 |
| WO | 2005124159 | 12/2005 |
| WO | 2007/073447 | 6/2007 |
| WO | 2007140148 | 12/2007 |

OTHER PUBLICATIONS

PCT/US2007/086357 ISR/WO.

* cited by examiner

*Primary Examiner*—Hoang M Nguyen
(74) *Attorney, Agent, or Firm*—Brian Pangrle

(57) ABSTRACT

The present invention provides an assembly comprising a compressor housing and EGR mixer, the assembly further comprising a ported shroud in the compressor housing and a noise suppressor in the EGR mixer.

6 Claims, 2 Drawing Sheets

EGR MIXER AND PORTED SHROUD COMPRESSOR HOUSING

CROSS-REFERENCES TO RELATED APPLICATIONS

Not Applicable.

BACKGROUND OF THE INVENTION

1. Field of the Invention (Technical Field)

The present invention relates to a compressor housing and EGR mixer assembly, the assembly comprising a ported shroud in the compressor housing and a noise suppressor in the EGR mixer.

2. Description of Related Art

Note that the where the following discussion refers to a number of publications by author(s) and year of publication, due to recent publication dates, certain publications are not to be considered as prior art vis-a-vis the present invention. Discussion of such publications herein is given for more complete background and is not to be construed as an admission that such publications are prior art for patentability determination purposes.

Turbocharger variable geometry compressors must be compatible with long route EGR (exhaust gas recirculation) mixers. In the prior art, such compressors are designed with non-ported shroud compressor housings. However, to achieve a high pressure ratio and low flow, a ported shroud is needed, but such ported shrouds suffer from excessive noise in a wheel using full blades and splitters. Therefore, to reduce any noise in the ported shroud, the present invention provides for a variable geometry compressor that uses a full blade wheel design with the addition of a noise suppressor in the long route EGR mixer, the noise suppressor located at the compressor inlet next to the ported shroud.

BRIEF SUMMARY OF THE INVENTION

The present invention provides a compressor housing and EGR mixer assembly, the assembly comprising a ported shroud in the compressor housing and a noise suppressor in the EGR mixer. Thus, a non-limiting embodiment of the present invention provides a turbocharger compressor assembly comprising a compressor housing having a ported shroud, an EGR mixer attached at a compressor inlet of the compressor housing, said EGR mixer having a noise suppressor located next to the ported shroud. The EGR mixer may be attached at the compressor inlet of the compressor housing via a crimp in the EGR mixer over which a portion of the compressor housing is rolled. Preferably, the noise suppressor is integral to the EGR mixer.

Still another embodiment of the present invention provides a method for suppressing noise in a turbocharger compressor assembly, the method comprising providing a ported shroud in a compressor housing, attaching an EGR mixer at a compressor inlet of the compressor housing, and disposing a noise suppressor in the EGR mixer next to the ported shroud. Preferably, the EGR mixer is attached to the compressor housing by forming a crimp on the EGR mixer and rolling a portion of the compressor housing over the crimp. Preferably, the EGR mixer is stamped to form the noise suppressor as an integral part of the EGR mixer.

An object of the present invention is to provide for loser costs by using a long route EGR mixer to provide a ported noise suppressor at the ported shroud.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into, and form a part of, the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The present invention provides an assembly comprising a compressor housing and EGR (exhaust gas recirculation) mixer, the assembly further comprising a ported shroud in the compressor housing and a noise suppressor in the EGR mixer. The present invention is intended for use with long route EGR ("LREGR") systems. As used in the specification and claims herein, the terms "a", "an", and "the" mean one or more.

Figure 1:
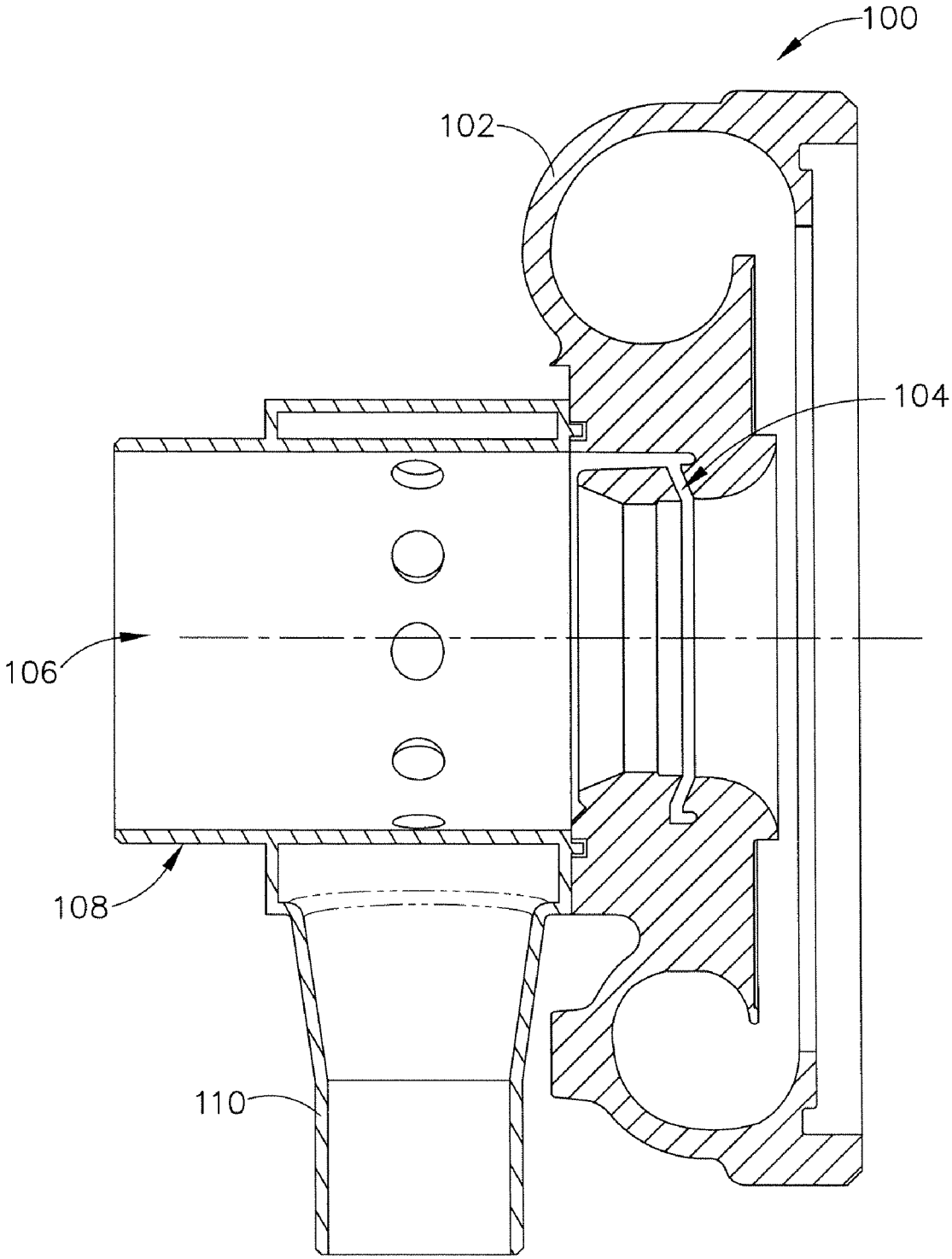
FIG. 1 (PRIOR ART)
FIG. 1 is a cutaway side view of the prior art showing a compressor housing and EGR mixer assembly.

Turning now to the figures, FIG. 1 shows a compressor with an EGR Mixer of the prior art. Reference to FIG. 1 provides a context for the present invention. Compressor 100 has compressor housing 102 having ported shroud 104. At compressor inlet 106, EGR mixer 108 is connected to compressor housing 102. The compressor of FIG. 1 has no noise suppressor, and EGR inlet port 110 is not an integral part of compressor housing 102.

In the non-limiting embodiment of the present invention shown in FIG. 2 and described as follows, compressor 200 has ported shroud 204 and EGR mixer 208 comprises noise suppressor 212. Noise suppressor 212 is located next to ported shroud 204. As in FIG. 1, EGR Mixer 208 is disposed at compressor inlet 206, but is here attached to compressor housing 202 via crimp 214 in EGR Mixer 208 over which portion 216 of compressor housing 202 is rolled. In this embodiment, EGR inlet port 210 is an integral part of compressor housing 202.

Figure 2:
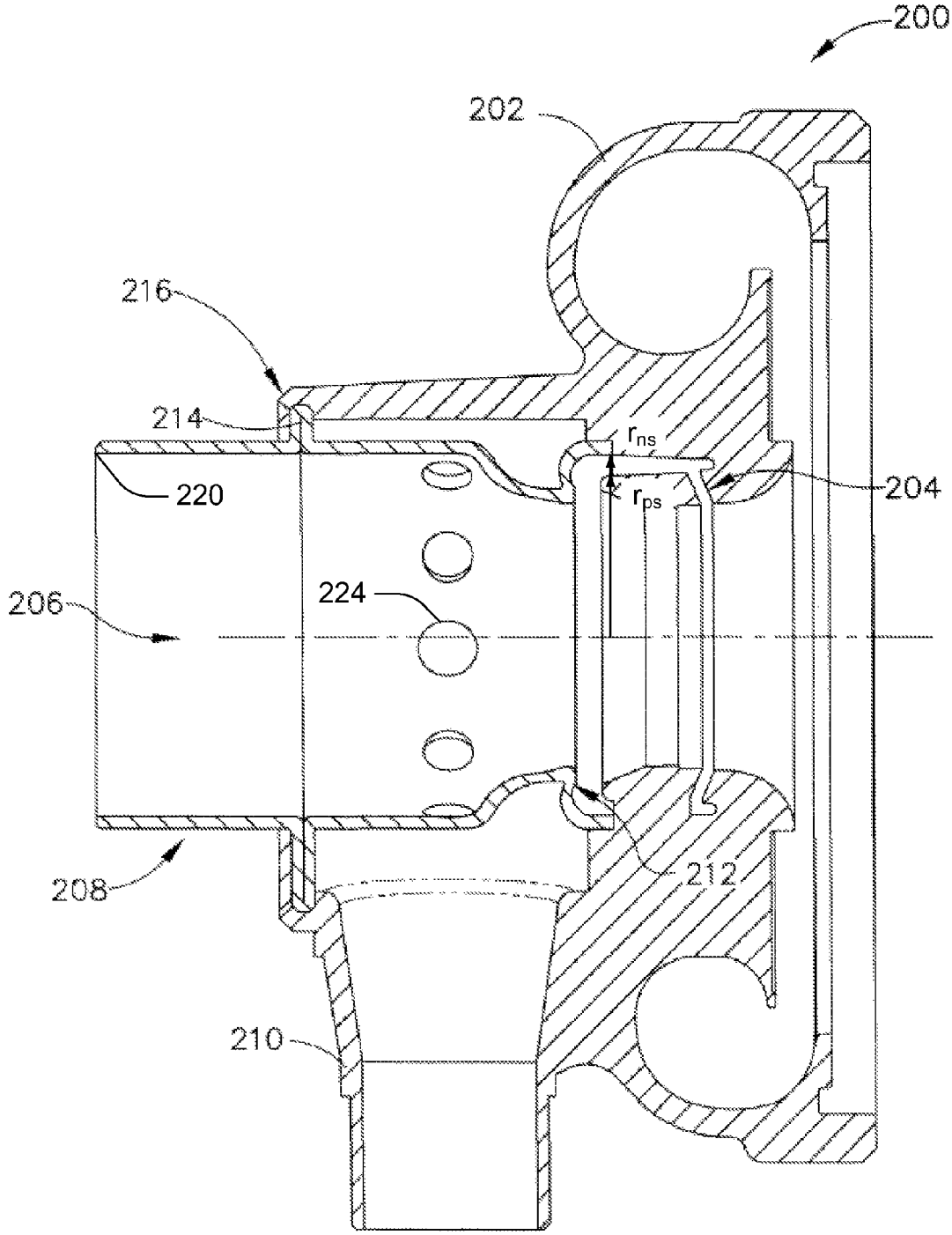
FIG. 2 is a cutaway side view of an embodiment of the present invention showing a compressor housing and EGR mixer assembly with ported shroud and noise suppressor.

FIG. 2 shows a compressor housing 202 and an EGR mixer 208 assembly. The compressor housing 202 includes a ported shroud 204 and an integral EGR inlet port 210. The EGR mixer 208 includes an air inlet 220 at one end, a noise suppressor 212 at an opposing end and a mixer section disposed between the two ends. As shown in FIG. 2, the mixer portion includes openings 224 that allow for mixing of exhaust gas received via the EGR inlet port 210 and inlet air received via the air inlet 220. As shown in FIG. 2, the noise suppressor 212 is located next to the ported shroud 204 and the noise suppressor 212 has a radius $r_{ns}$ that is larger than an outer radius $R_{ps}$ of the ported shroud 204.

By using the long route EGR mixer to create the noise suppressor at the ported shroud, the cost of materials is reduced. In the embodiment shown in FIG. 2, the EGR mixer is preferably shaped by stamping to provide the ported shroud noise suppressor and to provide a clamping and sealing area with the compressor housing. The preferred attachment of the EGR mixer is by crimping (i.e., compressor housing material deformation by rolling) to provide a seal. Thus, the EGR mixer inlet forms part of the compressor housing casting. The functions of the EGR mixer and noise suppressor and ported shroud functions are achieved using two components, the compressor housing and mixer.

EXAMPLE

The invention is further illustrated by a non-limiting example comprising an assembly constructed and used in accordance with the specification and drawings herein.

The preceding examples can be repeated with similar success by substituting the generically or specifically described components, mechanisms, materials, and/or operating conditions of this invention for those used in the preceding example.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A turbocharger compressor assembly comprising:

a compressor housing having a ported shroud and having an EGR inlet port;

an EGR mixer attached to the compressor housing and having, at one end, an air inlet for said compressor housing and having, at an opposing end, a noise suppressor located next to said ported shroud and having, disposed between the two ends, a crimp and openings that provide for introduction of exhaust, received via the EGR inlet port, to inlet air, received via the air inlet and wherein the noise suppressor comprises a convergent portion, a throat portion and a divergent portion near the ported shroud.

2. The turbocharger compressor assembly of claim 1 wherein said EGR mixer is attached at a compressor inlet of said compressor housing via the crimp in said EGR mixer over which a portion of said compressor housing is rolled.

3. The turbocharger compressor assembly of claim 1 wherein said noise suppressor is integral to said EGR mixer.

4. A method for suppressing noise in a turbocharger compressor assembly, the method comprising:

providing a ported shroud in a compressor housing, the compressor housing having an EGR inlet port and a compressor inlet; and attaching an EGR mixer at the compressor inlet of the compressor housing via a crimp to provide an air inlet to the compressor housing wherein the attaching comprises disposing a noise suppressor in the EGR mixer next to the ported shroud and providing openings in the EGR mixer for introduction of exhaust, received via the EGR inlet port, to inlet air, received via the air inlet and wherein the noise suppressor comprises a convergent portion, a throat portion and a divergent portion near the ported shroud.

5. The method of claim 4 wherein the EGR mixer is attached to the compressor housing by forming the crimp on the EGR mixer and rolling a portion of the compressor housing over the crimp.

6. The method of claim 4 wherein the EGR mixer is stamped to form the noise suppressor as an integral part of the EGR mixer.

* * * * *